US007266886B2

(12) United States Patent
Estienne et al.

(10) Patent No.: US 7,266,886 B2
(45) Date of Patent: Sep. 11, 2007

(54) METHOD OF CONTINUOUSLY FABRICATING A CORRUGATED COAXIAL CABLE

(75) Inventors: Thierry Estienne, Mortain (FR); Gérard Besnier, Mesnil Gilbert (FR); Jean-Paul Duc, Romagny (FR)

(73) Assignee: Acome Societe Cooperative de Travailleurs, Paris (FR)

( * ) Notice: Subject to any disclaimer, the term of this patent is extended or adjusted under 35 U.S.C. 154(b) by 565 days.

(21) Appl. No.: 10/323,162

(22) Filed: Dec. 18, 2002

(65) Prior Publication Data

US 2003/0111768 A1 Jun. 19, 2003

(30) Foreign Application Priority Data

Dec. 19, 2001 (FR) ..... 01 16458

(51) Int. Cl.
*H01B 13/20* (2006.01)

(52) U.S. Cl. ..... 29/828; 29/825; 72/184; 156/54; 228/130

(58) Field of Classification Search ..... 29/825, 29/828; 156/54; 228/130; 72/184
See application file for complete search history.

(56) References Cited

U.S. PATENT DOCUMENTS 2,018,477 A * 10/1935 Wentz ..... 174/29
2,156,934 A * 5/1939 Barrett ..... 228/17.5
3,572,074 A 3/1971 Holdup et al.
3,635,111 A * 1/1972 Zieg et al. ..... 83/183
3,691,488 A * 9/1972 Holtum, Jr. ..... 333/237
3,941,296 A * 3/1976 Ziemek ..... 228/148
3,945,552 A * 3/1976 Tobita et al. ..... 228/17.5
4,043,161 A 8/1977 Toma et al.
4,083,484 A * 4/1978 Polizzano et al. ..... 228/130
4,378,462 A * 3/1983 Arnold et al. ..... 174/70 A
4,758,685 A * 7/1988 Pote et al. ..... 174/29
4,778,543 A * 10/1988 Pan ..... 156/54
5,181,316 A * 1/1993 Pote et al. ..... 29/828
5,926,949 A * 7/1999 Moe et al. ..... 29/828
6,073,473 A * 6/2000 Ziemek ..... 72/78
6,405,919 B2 * 6/2002 Frohne et al. ..... 228/173.7

FOREIGN PATENT DOCUMENTS

GB 935260 8/1963
JP 06-020540 * 1/1994

* cited by examiner

*Primary Examiner*—Carl J. Arbes
(74) *Attorney, Agent, or Firm*—Blakely Sokoloff Taylor & Zafman

(57) ABSTRACT

The invention relates to a method of continuously fabricating a coaxial cable in which ring-shaped corrugations are imparted to a conductor of the cable in a corrugator. The corrugator is made to operate at constant speed.

12 Claims, 3 Drawing Sheets

METHOD OF CONTINUOUSLY FABRICATING A CORRUGATED COAXIAL CABLE

The present invention relates to a method of fabricating a corrugated coaxial cable.

BACKGROUND OF THE INVENTION

Coaxial cables are nowadays in widespread use for numerous applications, and in particular for transmitting signals at radio frequency. For example, such cables are known for conveying television signals or telephone signals for various generations of cellular telephones.

A coaxial cable comprises a central conductor surrounded by a dielectric and by a peripheral conductor which is generally protected by a polymer sheath. In many cases, the dielectric is constituted by an expanded and extruded polymer, and the peripheral conductor is made of copper or of aluminum. In numerous cases, the peripheral conductor is corrugated so as to give the coaxial cable flexibility that is compatible with conditions during installation while nevertheless guaranteeing the best possible transmission qualities.

It is well known that these transmission qualities depend both on the intrinsic qualities of the inner and peripheral conductors and of the dielectric, and also on compliance with various nominal geometrical values for said conductors, these values being characterized by the outside diameter of the central conductor, by the inside diameter of the peripheral conductor or an equivalent diameter if it is corrugated, and finally by the regularity of these intrinsic characteristics or these nominal values along the axis of the cable. The method of fabrication is thus a major contributor not only to the economic aspects of the finished cable both in raw costs and in costs related to fabrication efficiency, but also in the ability to make the cable at high speeds while maintaining good quality.

Although known methods do indeed enable high quality products to be made that are widely available, they nevertheless suffer from certain drawbacks. Thus, the methods in the most widespread use are based on taking the already-fabricated central conductor surrounded by its dielectric from a supply reel, and then inserting this cable element into the cylindrical peripheral conductor which is being pulled by a "caterpuller" and which is then corrugated prior to being wound onto a take-up reel. On leaving the upstream reel, the central conductor element surrounded in its dielectric passes through a jumping roller system serving to regulate the speed at which it is unwound from the reel. On leaving the corrugator, the cable element including the corrugated peripheral conductor passes through another jumping roller system serving likewise to regulate the speed of rotation of the take-up reel.

In that method, the reference for winding speed is the speed of the caterpuller for pulling the peripheral conductor. As a result, and in spite of regulation at the supply reel and at the take-up reel, the corrugating head is subjected to a force that varies continuously both in magnitude and in direction because of the continuous variations in the speed of the supply reel, which corresponds to the quantity of the intermediate product varying per unit time, and to continual variations in the speed of the take-up reel, which in turn corresponds to the quantity of finished product varying per unit time.

As a result, that method implies measuring or estimating the axial force acting on the corrugating head and continuously returning said head to its equilibrium position by modifying the speed of rotation of the tooling used for making the corrugations. Such modification in speed itself gives rise to modifications in tension over the entire line and thus acts via the above-mentioned jumping roller systems to modify the delivery and take-up speeds of the above-mentioned reels.

This situation can be summarized by observing that in such a method the peripheral conductor is supplied to the corrugator at a given speed which is the speed that acts as the speed reference for the fabrication line. The quantity of conductor thus supplied is equal to the quantity of conductor consumed by the corrugator, with this quantity thus being a function of the reference speed of the caterpuller and of the diameter of the soldered conductor tube prior to penetrating into the corrugator. This same quantity of conductor that is consumed is naturally a function of corrugation parameters, and in particular the diameter of the corrugation ridge, of the corrugation furrow, and of the shape of the corrugation. The central conductor carrying its dielectric is entrained by the corrugating operation which is performed by applying compression to the dielectric and tension is needed to tighten the central conductor element with its dielectric.

The use of such a method thus requires both a speed to be defined for the peripheral conductor (which is in the form of a tube prior to being corrugated), and a diameter to be defined for said peripheral conductor, and it is then necessary to compute an approximate speed of rotation for the corrugating head. During startup tests, the various tensions are adjusted in order to obtain the desired dimensioning, in particular the tension for unwinding the supply reel and the tension for accumulating cable on the take-up reel.

Under those circumstances it will be understood that changing a single parameter requires all of the other parameters to be changed in order to conserve the desired dimensioning, which means firstly that operation is too complex for excellent efficiency to be likely, and secondly that there are numerous risks of malfunction which lead either to poor quality or else to additional production going to scrap.

Finally, in such a method, given the variation in the speed of the supply reel and thus in the tension induced for the cable element that is inserted into the peripheral cylindrical conductor (i.e. the element comprising the central conductor with its dielectric), it can be assumed that the slip of the peripheral conductor over the dielectric is never constant. This is particularly important when the incident cable element comprising the central conductor carrying its dielectric passes through only one jumping roller system on leaving the initial reel since it then tends to retain its initial curvature that it had on the reel. Unfortunately, this curvature is not uniform and changes as the reel unwinds, which means that this cable element is naturally of unstable position at the time it is inserted into the peripheral conductor. This means that parameters need to be adjusted in order to produce a compliant cable. Furthermore, irregular distribution of the dielectric on the upstream reel is transferred directly to the corrugator in terms of varying tension that gives rise to variation in the shape of the corrugations.

Existing methods are thus based on continuously regulating a system comprising a plurality of parameters around an optimum operating point which can itself be obtained only after making progressive adjustments. (Some existing methods do not even include the operating flexibility provided by the corrugating head having a floating mount which can be used to regulate the speed of rotation of the corrugating head.) In all cases, existing methods are thus methods of making high quality cables but at the cost of great difficulty in terms of controlling and governing the method, and requiring vigilance that is poorly compatible with certain modern production requirements, and speeds that are very limited. All of these points inevitably have consequences, even if relatively small, on the good quantity of a product such as a coaxial cable, even though its performance is specifically determined, in part, by the need for a very high degree of geometrical uniformity in its component elements. Finally, it also follows that efficiency is fairly bad due either to time required for adjustment purposes or to lengthy readjustments requiring operations that are difficult, or else to reject rates that are rather high due in particular to drift in performance.

OBJECTS AND SUMMARY OF THE INVENTION

An object of the present invention is thus to remedy those numerous drawbacks by providing a method that is more stable and easier to adjust while also making it possible to envisage higher speeds of fabrication without any risk of degrading quality, and simultaneously reducing scrap and defects due to fabrication drift.

The invention also makes it easier to perform certain operations in tandem such as making the dielectric or the sheathing.

The present invention thus seeks to provide greater stability and increased productivity so as to make it possible to increase speeds.

In a first aspect, the invention relies on the principle which consists in causing the corrugator to operate at a constant speed. In a second aspect which can be implemented independently of the first aspect or together therewith, the speed of operation of the corrugator is selected as a speed reference for adjusting the speed of at least one of the drive elements of the apparatus for moving the cable or a portion of the cable during the fabrication process.

More particularly, the invention provides a method of continuously fabricating a coaxial cable in which corrugations are imparted to a conductor of the cable in a corrugator and in which the corrugator is caused to operate at constant speed.

The method of the invention may present one or more of the following characteristics:

- upstream from the corrugator, the conductor is driven at an intermediate speed that is constant;
- the intermediate speed is adjusted as a function of the speed of the corrugator;
- a cable element is inserted into the conductor at an insertion station situated upstream from the corrugator;
- the cable element upstream from the insertion station is driven at an upstream speed that is constant;
- the upstream speed is adjusted as a function of the speed of the corrugator;
- a rectilinear shape is imparted to the cable element upstream from the insertion station;
- the conductor downstream from the corrugator is driven at a downstream speed that is constant;
- the downstream speed is adjusted as a function of the speed of the corrugator; and
- the downstream speed is equal to the intermediate speed.

The invention also provides apparatus for continuously fabricating a coaxial cable, the apparatus including both a corrugator for imparting corrugations to a conductor of the cable and control means arranged to cause the corrugator to operate at constant speed.

The apparatus of the invention may further present at least one of the following characteristics:

- upstream from the corrugator it includes an upstream caterpuller for driving a cable element for insertion into the conductor; and
- downstream from the corrugator it includes a downstream caterpuller for driving the conductor.

The invention also provides a method of continuously fabricating a coaxial cable comprising the steps consisting in:

- at at least one drive station driving a portion of the cable at a drive speed;
- in a corrugator, imparting corrugations to a conductor of the cable; and
- the drive speed is adjusted as a function of a corrugator speed.

The method of the invention may also advantageously present at least one of the following characteristics:

- the corrugator is situated downstream from the drive station;
- the portion of the cable at the drive station includes the conductor;
- in an insertion station, the cable portion is inserted into the conductor, the drive station being situated upstream from the insertion station; and
- the drive station is situated downstream from the corrugator.

The invention also provides apparatus for continuously fabricating a coaxial cable, the apparatus comprising:

- a corrugator for imparting corrugations to a conductor of the cable;
- at least one drive station for driving a portion of the cable; and
- control means;

in which the control means are arranged to control a drive station speed as a function of a corrugator speed.

The apparatus of the invention may advantageously present at least one of the following characteristics:

- the corrugator is situated downstream from the drive station;
- at the drive station, the cable portion includes the conductor;
- it includes an insertion station for inserting the cable portion into the conductor, the drive station being situated upstream from the insertion station; and
- the drive station is situated downstream from the corrugator.

In any of the methods of the invention, provision can be made for:

- a sheath to be installed on the conductor downstream from the corrugator: and/or
- a central conductor and a dielectric of the cable to be assembled together upstream from the corrugator.

BRIEF DESCRIPTION OF THE DRAWINGS

Other characteristics and advantages of the invention appear further from the following description of two preferred embodiments given as non-limiting examples with reference to the accompanying drawings, in which.

MORE DETAILED DESCRIPTION

Figure 1:
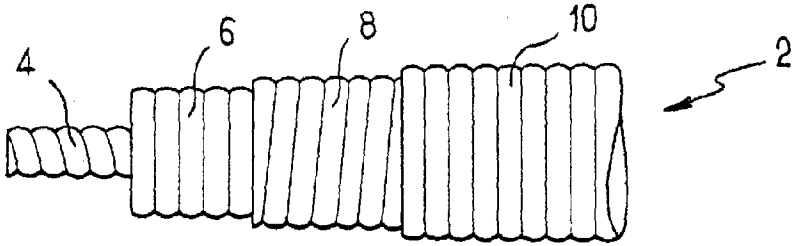
FIG. 1 is a side view of one end of a coaxial cable fabricated using the method of the invention, showing the various layers of the cable.

In the embodiments described below, the method of the invention seeks to fabricate a corrugated coaxial cable 2 as shown, for example, in FIG. 1. The cable comprises a metal central conductor 4 constituting the core of the cable. The cable comprises dielectric material 6 in the form of a cylindrical tube covering the central conductor 4. In this case the dielectric is constituted by an expanded and extruded polymer. The cable further comprises a peripheral conductor 8 in the form of a cylindrical tube covering the dielectric material 6. Finally, the cable comprises a sheath 10 of polymer material in the form of a cylindrical tube covering the peripheral conductor 8. The layers 4, 6, 8, and 10 follow one another directly in that order going radially outwards from the central axis of the cable. Such a structure is conventional and is not described in further detail herein.

The peripheral conductor 8 is corrugated in conventional manner so as to give the cable a degree of flexibility. The corrugating operation consists in forming a helical furrow or in imparting right corrugations to the peripheral conductor from the outside face thereof in order to give it the appearance of a succession of rings.

Figure 2:
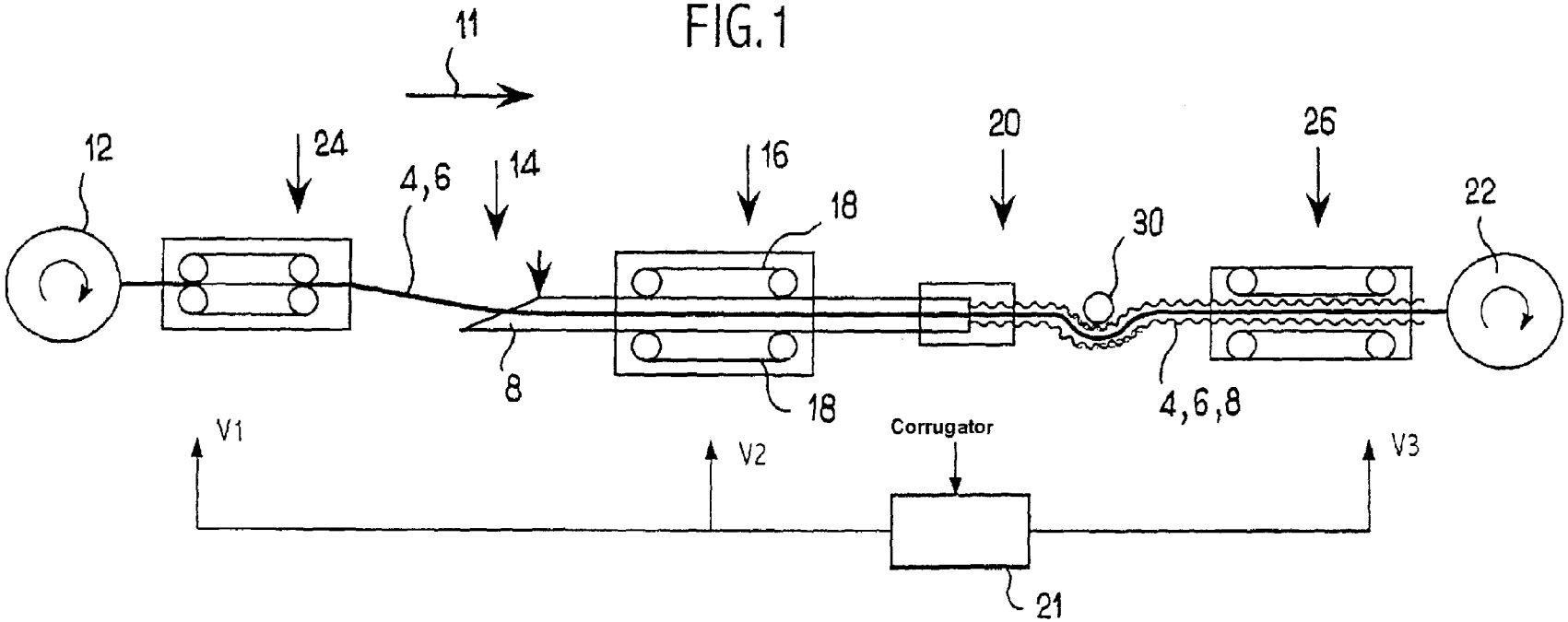
FIG. 2 is a diagrammatic elevation view of a fabrication line constituting an embodiment of the invention.

In conventional manner, the device shown in FIG. 2 comprises a supply reel 12 or upstream reel carrying a supply of cable element constituted at this stage solely by the central conductor 4 and the dielectric 6 surrounding it.

The apparatus forming a fabrication line comprises various stations that the cable element passes through in succession, with fabrication nevertheless taking place continuously. The upstream and downstream directions therefore refer to the travel direction of the cable element during fabrication, as shown by arrow 11.

Downstream from the reel 12, the line comprises an insertion station 14 where the cable element 4, 6 coming from the reel is inserted into the peripheral conductor 8 which is still in the state of a smooth tube.

Downstream from the insertion station, the line has an intermediate drive station 16 through which the peripheral conductor 8 is driven in the downstream direction. This station comprises in particular a caterpuller 18 comprising two endless belts driving the conductor along a rectilinear horizontal path, the belts extending above and below the conductor on either side thereof so as to sandwich it.

Downstream from the intermediate drive station 16, the line has a corrugating station or corrugator 20 in which the corrugations are imparted to the peripheral conductor 8.

Finally, at the downstream end of the line, there is a downstream reel or take-up reel 22 onto which the cable element is wound, which element now comprises the central conductor 4, the dielectric 6, and the corrugated peripheral conductor 8.

Figure 3:
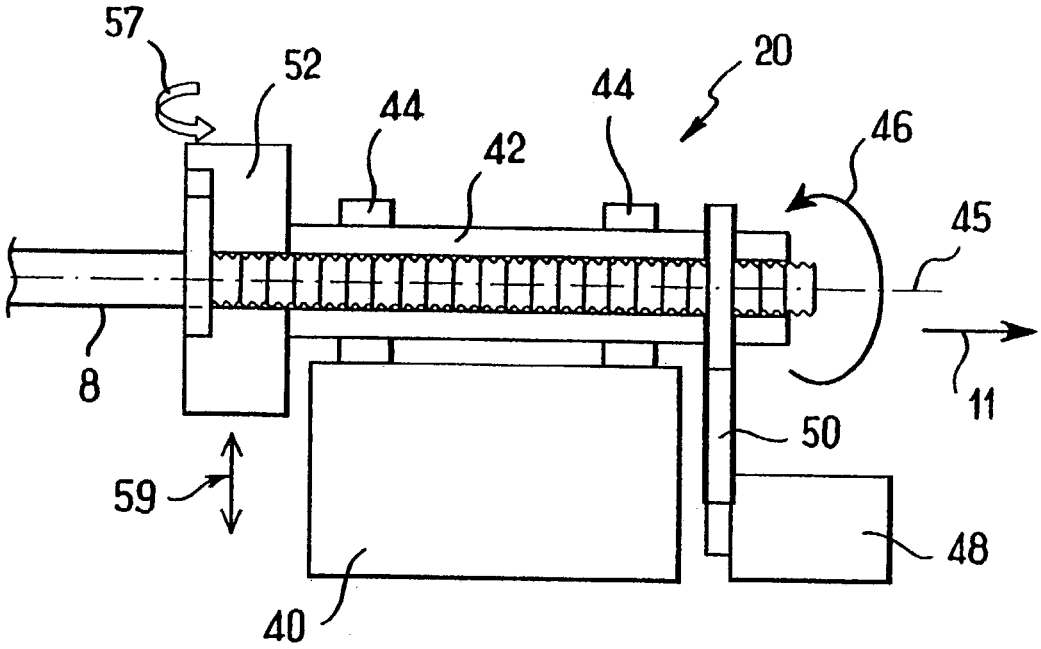
FIG. 3 is a diagrammatic longitudinal section view through the corrugator in the line of FIG. 2.
Figure 4:
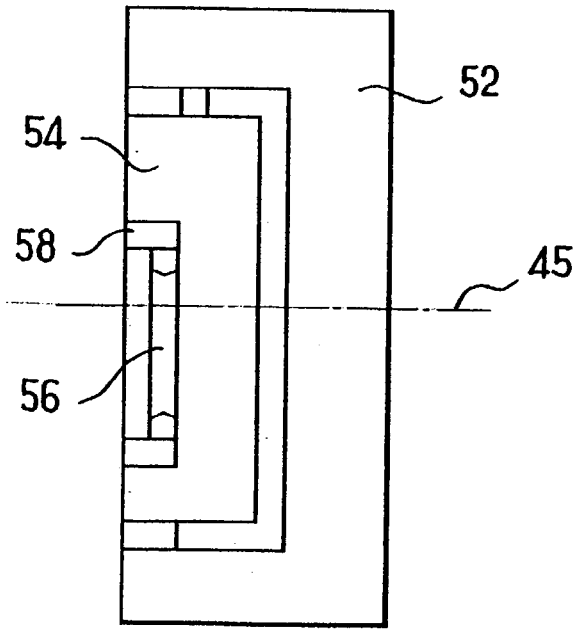
FIG. 4 is a diagrammatic longitudinal section view through the head of the FIG. 3 corrugator.

The corrugator 20 is of conventional type and it is described briefly below with reference to FIGS. 3 and 4.

The corrugator 20 comprises a frame 40 and a hollow shaft 42 through which the cable element being fabricated passes along its axis 45. The corrugator has two ball bearings 44 enabling the shaft to rotate relative to the frame about its axis 45 which is also the axis of the cable. This rotation is represented by arrow 46. The cable element slides through the shaft in the downstream direction 11 parallel to said axis, without itself revolving. To avoid problems of friction in contact with the shaft, sufficient clearance is provided between them.

The corrugator has a motor 48 driving the shaft 42 in rotation by means of a transmission 50.

The corrugator has a corrugating head 52 fixed rigidly to the upstream end of the shaft 42 and consequently rotating at the same speed. This speed of rotation is referred to in the present description as the speed of the corrugator.

The corrugator has a tool carrier 54 connected to the head 52 by a transverse pin 56 extending radially relative to the axis of rotation 45. The head has pin actuator means for adjusting both the radial position of the tool carrier relative to the head as represented by arrow 57 and also its angular position as represented by arrow 59, as a function of the parameters of the desired corrugation.

The corrugator has tooling 56 of annular or helical shape depending on the type of corrugation, the tooling being received in the tool carrier 54, and a ball bearing 58 being interposed radially between them. The tooling 56 and the bearing 58 share a common axis (not shown) parallel to the axis 45 and offset therefrom, or else inclined relative to the axis 45. Because of the presence of the bearing 58, the tooling 56 is free to rotate relative to the tool carrier 54 which, as a result, does no more than define the annular and radial position of the tooling relative to the axis 45 of the cable.

In operation, the tooling 56 rolls on the cable 2, making corrugations by deforming the peripheral conductor 8. This movement is the result of the combination of the corrugator rotating 46 and of the cable sliding through the corrugator.

In the invention, the line further comprises an upstream drive station 24 mounted downstream from the upstream reel 2 and upstream from the insertion station 14.

The line also comprises a downstream drive station 26 extending downstream from the corrugator 20 and upstream form the take-up reel 22. This drive station serves to drive the cable element carrying the corrugated peripheral conductor 8 towards the reel.

The drive stations 24 and 26 are made essentially in the same manner as the intermediate drive station 16, each comprising a caterpuller.

As can be seen in FIG. 2, this line does not include any jumping roller system interposed between the caterpuller 24 and the corrugator 20 for the purpose of adjusting the tension in the cable element. Similarly, in the present example, the downstream jumping roller system that is usually placed between the corrugator 20 and the take-up reel 22 and that serves to regulate speed is replaced by a simple guide pulley 30.

Thus, in this example, the cable element formed solely by the inner conductor 4 and the dielectric 6 is made to pass through the upstream drive station 24 at a prescribed speed, thus ensuring not only that the cable element moves at a stable speed V1, but also removing its memory of curvature so as to make it rectilinear and avoid any turbulence on insertion into the peripheral conductor 8 which is in turn driven by the intermediate station 16 at a speed V2.

This method of insertion has the advantage of not disturbing the edge-to-edge positioning of the copper tape under the soldering torch, and thus reduces the risk of solder defects. It also has the advantage of putting the dielectric in an optimum position relative to the hot point given by soldering the conductor.

In the present embodiment of the invention, the speeds V1 and V2 of these two stations are fixed and remain constant over time. This avoids the drawback of parasitic relative slip between the cable element constituted by the central conductor 4 carrying its dielectric 6 and the corrugated peripheral conductor 8 in the corrugator 20.

The cable element carrying both its dielectric and the soldered peripheral conductor prior to corrugation is thus delivered to the corrugator 20 at speeds which are given and predetermined. The quantity of peripheral conductor determined by the caterpuller 16 is equal to the quantity of peripheral conductor that is consumed by the corrugator 20. This quantity of peripheral conductor that is consumed is a function of the speed V2, of the diameter of the peripheral conductor tube 8, and of the corrugation parameters, i.e. the ridge diameter of a corrugation, the furrow diameter of a corrugation, and the pitch and the shape of the corrugations.

As a result, this positive drive enables the speed of rotation of the corrugating head 20 to be fixed. In the invention, this becomes the reference speed, unlike prior methods which take the speed of the intermediate station as the reference speed. In addition, in this case the speed of the corrugator is constant.

Similarly, in the method of the invention, the speed V3 of the downstream station 26 is made to be equal to the speed V1 of the upstream station 24 driving the central conductor carrying its dielectric. This speed V3 remains proportional to the reference speed which is the speed of the corrugator, regardless of what that speed might be, even during stages when speed is being raised or lowered. The same applies for the speed of the station 24.

Thus, in the present implementation of the invention, a speed is defined for the corrugator, as are its tooling, a corrugation ridge diameter, and a corrugation furrow diameter. Thereafter, on the basis of these parameters, the speed V2 for the peripheral conductor tube 8 is defined, as are the diameter of the tube and the speed V1 of the cable element comprising the central conductor 4 and the dielectric 6. These calculations are within the competence of the person skilled in the art.

As a result, when the method is implemented, it is much easier than in known methods to adjust it for proper operation, and thereafter operation is highly stable.

It can be seen that the method of the invention eliminates the drawbacks of known methods associated with continuous instability and with the difficulty of control by relying on predetermined drive speeds and on a stable corrugating speed. The method also avoid instabilities due to the winding memory of the dielectric 8, to variations in the diameter of the dielectric, and to the differing variations in tension on either side of the corrugator.

This very stable operation also corresponds to the fact that stresses on the die are minimized, giving rise to an advantageous standing wave ratio (SWR). Similarly, the absence of any variation in tension while winding onto the downstream reel 22 has a beneficial effect on SWR.

Naturally, the line includes control means 21 for setting the speed of the corrugator 20.

The corrugator 20 and the various drive stations 24, 16, 26 can be driven by a common motor drive. Nevertheless, given the problems that can often arise with possible transmission slack and vibration due to cyclical variations as generated by a mechanical transmission system, it is advantageous to provide electronic regulator means for adjusting the speed of each drive station.

The pulley 30 supplies a minimum amount of tension, and in practice the tension it provides is sufficient to ensure that the cable leaves the corrugator but without interfering with the formation of the corrugations.

Figure 5:
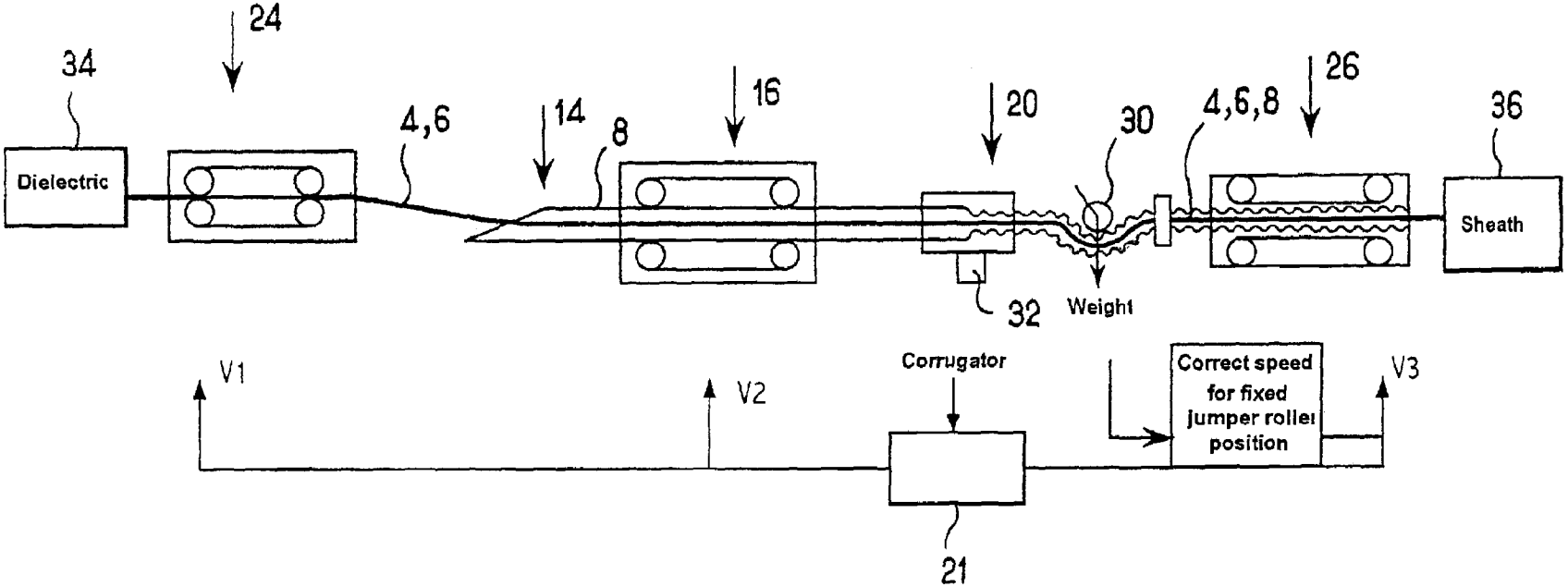
FIG. 5 is a view analogous to FIG. 2 showing another embodiment of the invention.

FIG. 5 shows a second embodiment that is quite similar to that of FIG. 2.

In this second embodiment, given the high operating stability of the fabrication line of the invention and given the way the various elements are controlled in terms of speed and not in terms of tension, it is also possible to provide for the corrugation apparatus to be put in tandem with a line 34 for fabricating the cable element comprising the conductor 4 carrying its dielectric 6, or indeed with a line 36 for putting the outer sheath 10 into place.

Thus, as shown in FIG. 5, instead of the upstream reel 12, there is placed upstream from the upstream drive station 24 a fabrication line 34 (not shown in detail but conventional) in which the dielectric 6 is put into place on the central conductor 4. This line operates continuously and in direct connection with the above-described fabrication line.

Alternatively, the line 34 may be replaced by two supply reels 12 operating alternately so that when one of the reels is completely emptied, the second reel immediately takes over. While the second reel is unwinding, the first reel is replaced with a full reel. This ensures that the line is fed continuously at its upstream end.

Likewise, downstream from the corrugating line it is possible to provide a sheathing line 36 that operates continuously and in direct connection with the above-described line of the invention. This sheathing line serves to put the sheath 10 into place on the cable element carrying its corrugated peripheral conductor 8.

It is also possible to envisage putting two take-up reels in tandem at this location.

In the present example, the line further comprises means for measuring the position of the pulley 30 in a vertical direction and for modifying the speed of the downstream drive station 26 when this position exceeds a predetermined threshold. The purpose of this speed control is to ensure that the pulley remains in a fixed position.

A tandem configuration makes the method particularly economical by providing very high quality yield and giving rise to a considerable reduction in scrap as occurs each time an individual operation is started.

In conventional manner, the invention can be implemented with a corrugator operating at a speed of 8000 revolutions per minute (rpm) to 15,000 rpm. All of the equipment in the line can be connected to a ruggedized data bus. The control means 21 may be connected to a computer receiving data from all of the members of the line so that the data can be displayed in real time for the purpose of monitoring fabrication and for archiving purposes.

Naturally, numerous modifications can be made to the invention without going beyond the ambit thereof as defined by the accompanying claims.

What is claimed is:

1. A method of continuously fabricating a coaxial cable in a fabricating line, comprising:

corrugating the periphery of a conductor of the cable by a corrugator, wherein the corrugator operates at a constant speed; and driving the cable along the line at a rate that is a function of the constant speed, wherein the constant speed of the corrugator is a reference speed value for each component of the fabricating line.

2. A method according to claim 1, wherein, upstream from the corrugator, the conductor is driven at an intermediate speed that is adjusted as a function of the speed of the corrugator.

3. A method according to claim 2, wherein the intermediate speed is constant.

4. A method according to claim 1, wherein a cable element is inserted into the conductor at an insertion station situated upstream from the corrugator.

5. A method according to claim 4, wherein the cable element upstream from the insertion station is driven at an upstream speed that is adjusted as a function of the speed of the corrugator.

6. A method according to claim 5, wherein the upstream speed is constant.

7. A method according to claim 4, wherein a rectilinear shape is imparted to the cable element upstream from the insertion station.

8. A method according to claim 1, wherein the conductor downstream from the corrugator is driven at a downstream speed that is adjusted as a function of the speed of the corrugator.

9. A method according to claim 8, wherein the downstream speed is constant.

10. A method according to claim 8, wherein, upstream from the corrugator, the conductor is driven at an intermediate speed that is constant, and wherein the downstream speed is equal to the intermediate speed.

11. A method according to claim 1, wherein a sheath is installed on the conductor downstream from the corrugator.

12. A method according to claim 1, wherein a central conductor and a dielectric of the cable are assembled together upstream from the corrugator.

* * * * *